US005947330A

United States Patent [19]

Kim

[11] Patent Number: 5,947,330

[45] Date of Patent: Sep. 7, 1999

[54] RAW MATERIAL SENSING APPARATUS FOR VENDING MACHINE AND METHOD OF SENSING RAW MATERIAL

[75] Inventor: Young-Ryol Kim, Kwangju, Rep. of Korea

[73] Assignee: Kwangju Electronics Co., Ltd., Kwangju, Rep. of Korea

[21] Appl. No.: 08/975,121

[22] Filed: Nov. 20, 1997

[30] Foreign Application Priority Data

Jul. 8, 1997 [KR] Rep. of Korea ..... 97-31612

[51] Int. Cl.[6] ..... B67D 5/10

[52] U.S. Cl. ..... 222/2; 222/64; 222/129.1

[58] Field of Search ..... 222/129.1, 146.2, 222/2, 64

[56] References Cited

U.S. PATENT DOCUMENTS 2,682,984 7/1954 Melikian et al. ..... 222/2

5,852,946 12/1998 Cowger ..... 222/64

*Primary Examiner*—Philippe Derakshani

*Attorney, Agent, or Firm*—Perman & Green, LLP

[57] ABSTRACT

A raw material sensing apparatus for a vending machine having a coin mechanism, an article selection panel, raw material receptacles, a hot water supply part, a mixing part for mixing raw materials with hot water, a dispensing part for providing a user with a mixture of the hot water and raw materials, including: a raw material output sensing part, monitoring whether or not raw materials are supplied to the mixing part from the raw material receptacles; and a control unit checking if raw materials for a user-desired article are supplied from the raw material receptacles according to an output signal of the raw material output sensing part, and when it determines that the raw materials are not supplied from the raw material receptacles, stopping vending, simultaneously with generating a signal for refunding coins, put into the vending machine, to the coin mechanism, and when it determines that the raw materials are supplied from the raw material receptacles, producing a signal for supplying hot water from the hot water supply part to the mixing part and then mixing the raw materials in the hot water, thus dispensing a mixture of the raw materials and hot water.

3 Claims, 6 Drawing Sheets

RAW MATERIAL SENSING APPARATUS FOR VENDING MACHINE AND METHOD OF SENSING RAW MATERIAL

BACKGROUND OF THE INVENTION

1. Field of the Invention

The present invention relates to a vending machine. More particularly, it relates to a raw material sensing apparatus for a vending machine which can monitor whether or not raw materials for a user-selected article are output during vending.

2. Description of the Prior Art

A vending machine is a kind of a self-service stand generally holds packets of cigarettes, containers of coffee, other soft drinks, snacks, and books, so consumers can obtain them by putting coins into it. FIG. 1 depicts a conventional coffee vending machine. As shown in FIG. 1, the coffee vending machine includes a casing 1 which constitutes the outer appearance of the vending machine, and a door 2 that is hinged on one side of the front of casing 1 for opening and closing casing 2. On the outer surface of door 2 are formed a doorknob 3 used when opening and closing door 2, an article selection panel 5 with a plurality of selection keys used to choose a cup of user-desired coffee, a cup dispenser 6 providing a user with a cup of the selected coffee, and a coin reject slot 7 through which small change is output.

The internal structure of the conventional vending machine, as shown in FIG. 2, consists of a cup column 8 holding a plurality of paper cups; raw material receptacles 9 holding several kinds of coffee powder, cream, sugar, etc., for various kinds of coffee; raw material supply parts 10 through which raw materials are furnished to a mixing part 13; a raw material chute 11 installed under raw material supply parts 10, thus directing the flow of raw materials from raw material supply parts 10; a hot water supply part 12 furnishing hot water to mixing part 13; and mixing part 13 mixing the hot water from hot water supply part 12 with the raw materials for coffee, delivered through raw material chute 11, and outputting the same to cup dispenser 6 through nozzles.

The following description relates to the operation of the conventional coffee vending machine.

When a user puts a given amount of coins into the coffee vending machine through a coin slot 4 and then selects a type of coffee he or she wants manipulating article selection panel 5, a cup is supplied from cup column 8 and put in cup dispenser 6 according to an output signal of a control unit of the vending machine. Several raw materials for the selected coffee, output from raw material receptacles 9, are provided to mixing part 13 through raw material chute 11. Mixing part 13 mixes the raw materials in hot water, supplied from hot water supply part 12, and this mixture is provided to cup dispenser 6 through nozzles, in a manner that the coffee vending machine dispenses him or her with a cup of the desired coffee.

However, in case that each of powdered raw materials within the vending machine forms a hard mass by inside moisture, the vending machine dispenses customers with hot water that is not mixed with raw materials, thus causing a money loss to them.

SUMMARY OF THE INVENTION

It is an objective of the present invention to provide a raw material sensing apparatus for a vending machine which monitors whether or not raw materials are supplied according to an instruction to dispense coffee or tea, and stops vending, refunding the input coins to a user if the raw materials are not furnished, thereby preventing a money loss to customers, and to further offer a method of sensing raw materials.

In order to obtain the above-mentioned objective of the present invention, there is disclosed a raw material sensing apparatus for a vending machine having a coin mechanism, an article selection panel, raw material receptacles, a hot water supply part, a mixing part for mixing raw materials with hot water, a dispensing part for providing a user with a mixture of the hot water and raw materials, including: a raw material output sensing part, monitoring whether or not raw materials are supplied to the mixing part from the raw material receptacles; and a control unit checking if raw materials for a user-desired article are supplied from the raw material receptacles according to an output signal of the raw material output sensing part, and when it determines that the raw materials are not supplied from the raw material receptacles, stopping vending, simultaneously with generating a signal for refunding coins, put into the vending machine, to the coin mechanism, and when it determines that the raw materials are supplied from the raw material receptacles, producing a signal for supplying hot water from the hot water supply part to the mixing part and then mixing the raw materials in the hot water, thus dispensing the user with a mixture of the raw materials and hot water.

According to another aspect of the present invention, a method of sensing raw materials for a vending machine having a coin mechanism, an article selection panel, raw material receptacles, a hot water supply part, a mixing part for mixing raw materials from the raw material receptacles with hot water from the hot water supply part, a dispensing part for providing a user with a mixture of the hot water and raw materials, including the steps of: checking if raw materials for a user-selected article are output to the mixing part from the raw material receptacles; when determining that the raw materials are output therefrom, supplying hot water from the hot water supply part to the mixing part so as to mix the raw materials with the hot water and then outputting a mixture of the raw materials and hot water to be dispensed to the user, and when determining that the raw materials are not output therefrom, giving coins, put into the vending machine, back to the user, simultaneously with stopping the vending operation.

Figure 1:
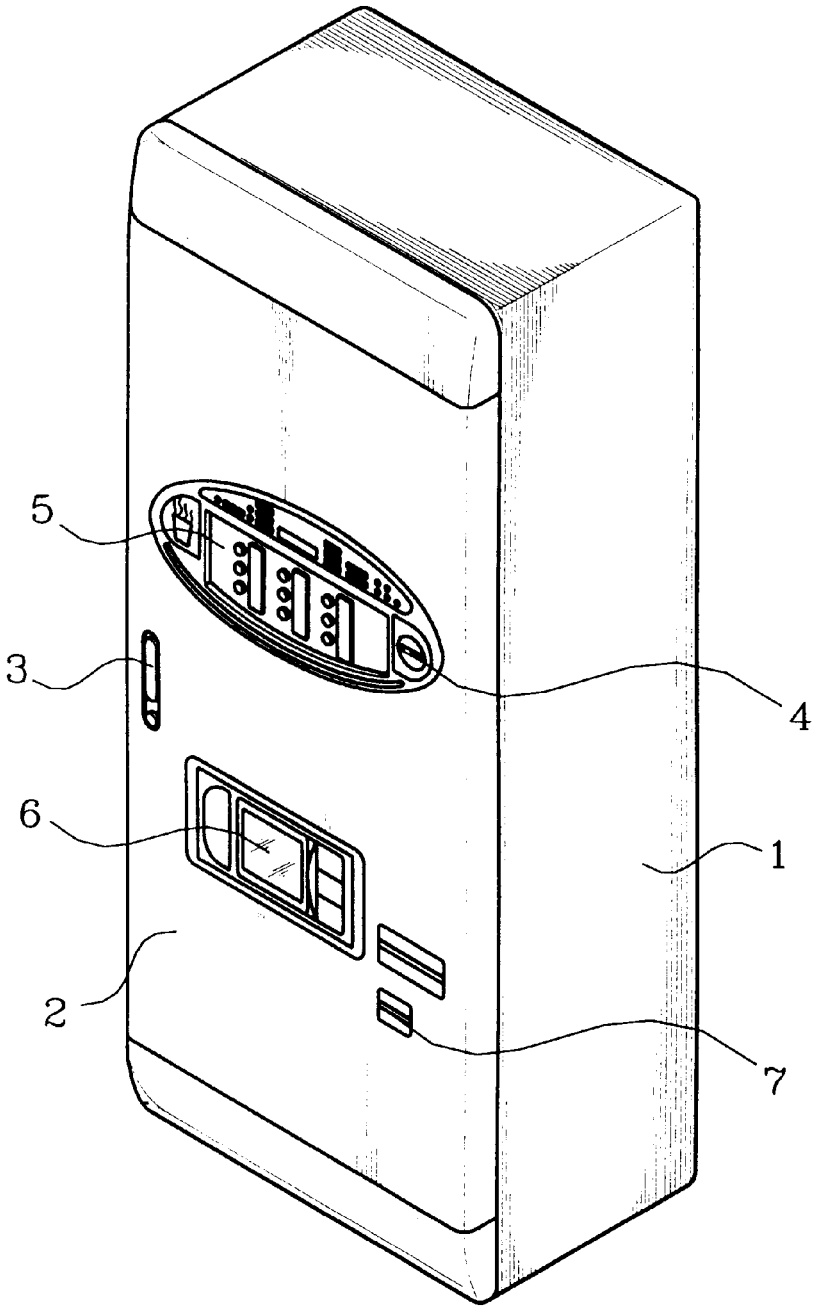
FIG. 1 schematically depicts the outer construction of a conventional vending machine.
Figure 2:
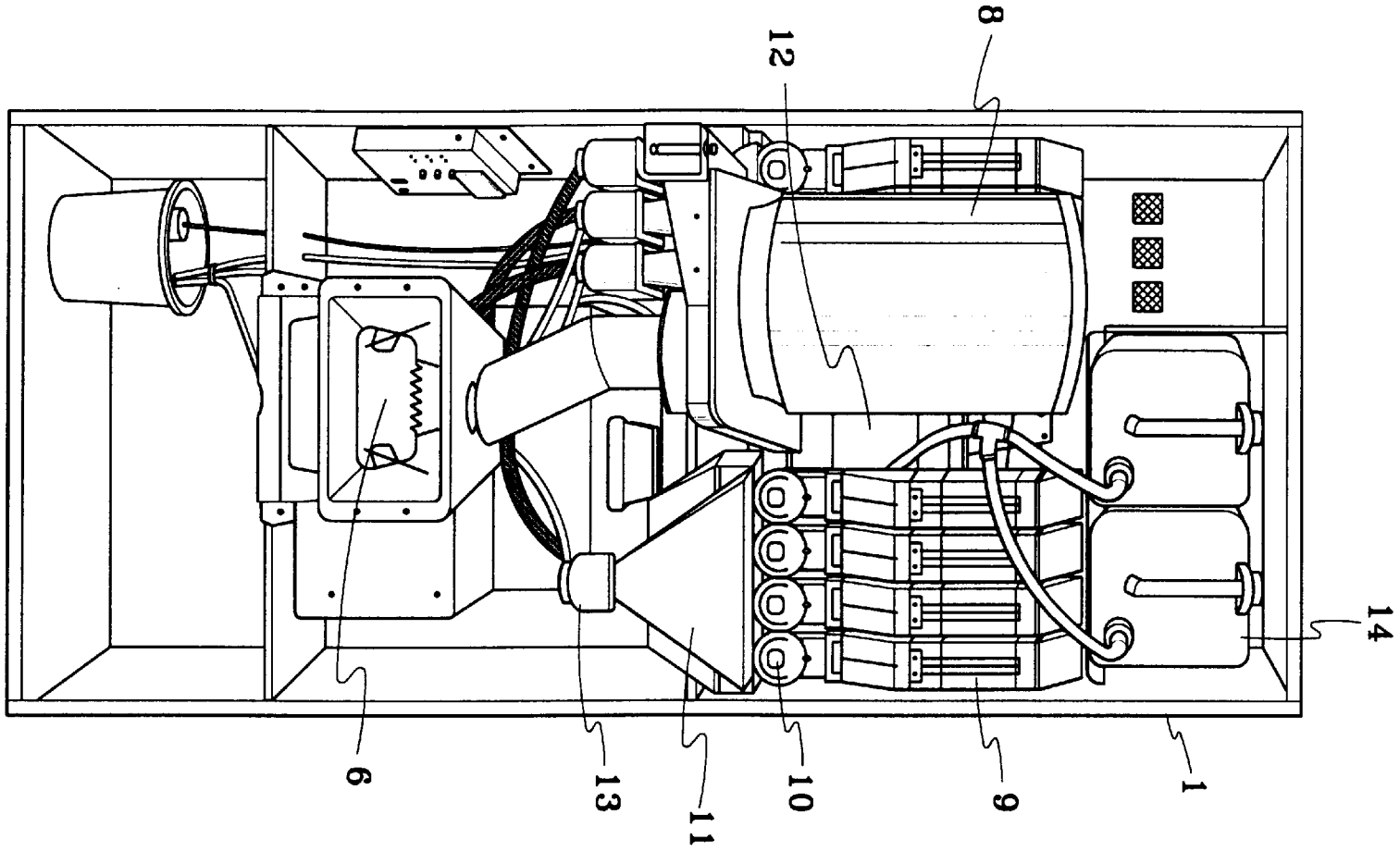
Figure 3:
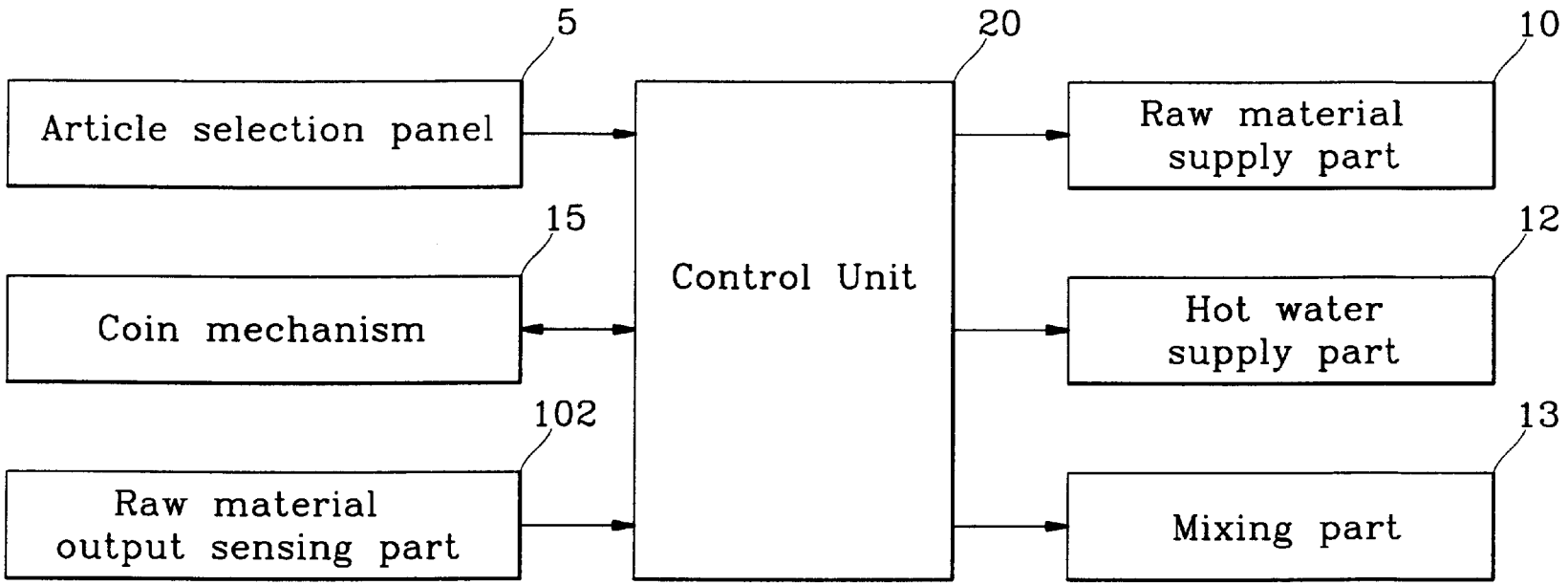
Figure 4:
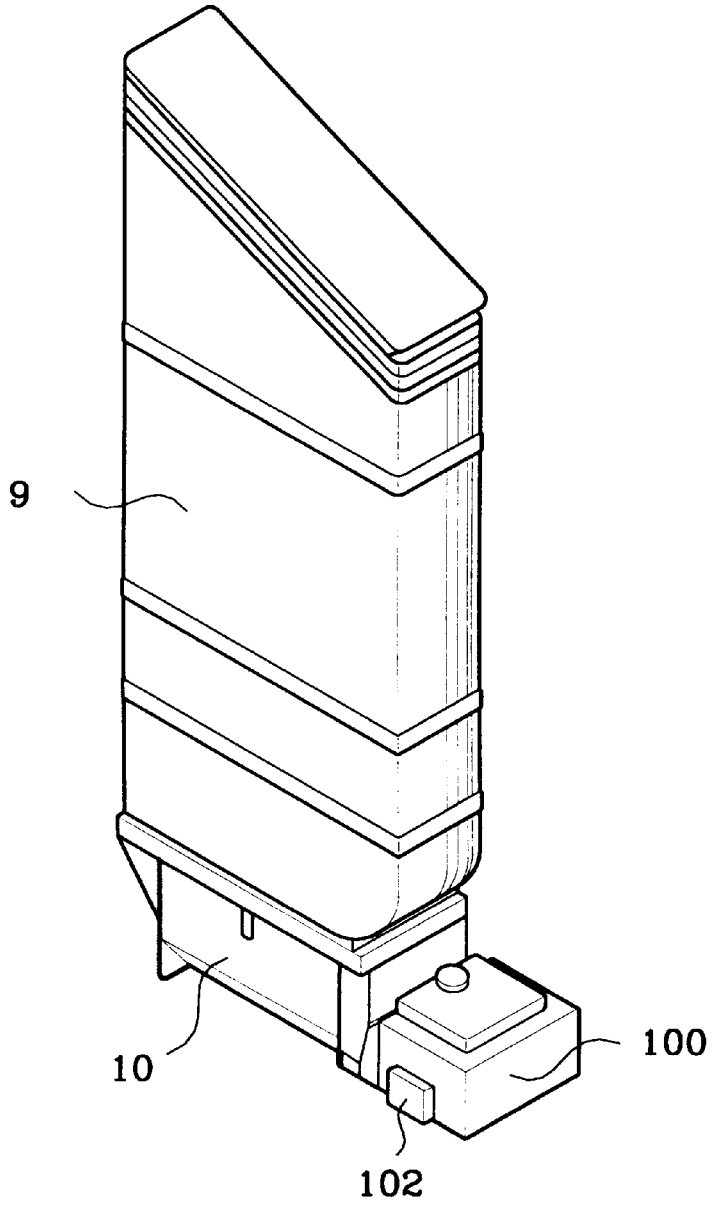
Figure 5:
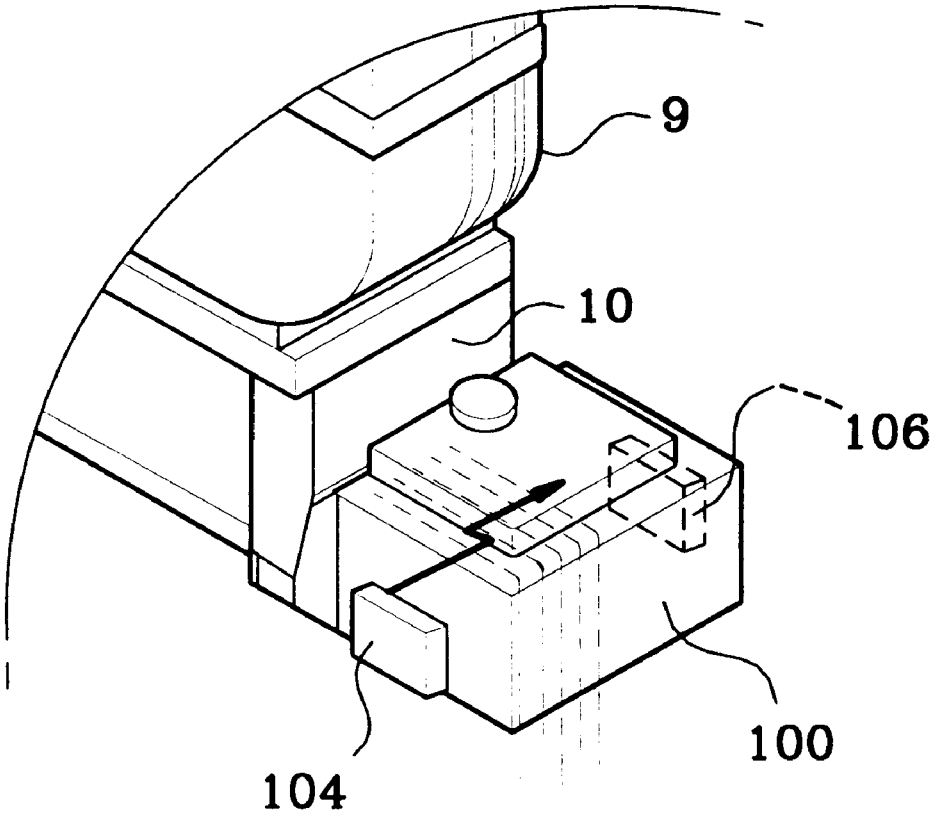

FIG; 2 depicts the internal structure of the conventional vending machine;

FIG. 3 is a block diagram of a raw material sensing apparatus for a vending machine in accordance with a preferred embodiment of the present invention;

FIG. 4 depicts installation of a raw material output sensing part of FIG. 3's raw material sensing apparatus;

FIG. 5 is a detailed view of FIG. 4; and

Figure 6:
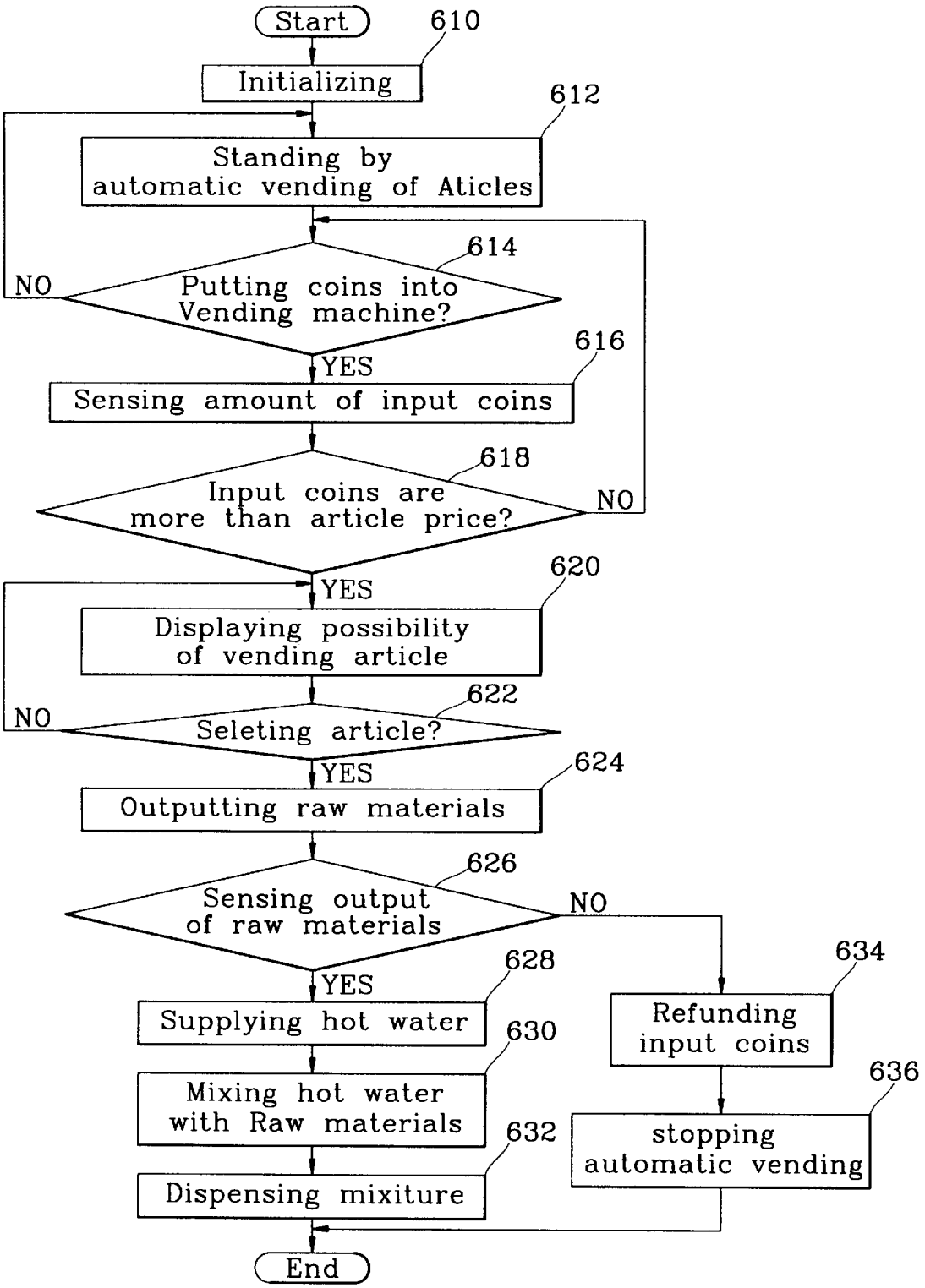

FIG. 6 depicts the control sequence of the raw material sensing apparatus in accordance with the present invention.

DETAILED DESCRIPTION OF THE PREFERRED EMBODIMENTS

Preferred embodiments of the present invention will be fully described referring to the accompanying drawings.

Similar reference numerals denote similar reference parts throughout the specification and drawings.

FIG. 3 is a block diagram of a raw material sensing apparatus for a vending machine in accordance with a preferred embodiment of the present invention. The raw material sensing apparatus includes an article selection panel 5, a coin mechanism 15, a raw material output sensing part 102, a control unit 20, a raw material supply part 10, a hot water supply part 12 and a mixing part 13.

As shown in FIG. 3, article selection panel 5 has a plurality of buttons used for selecting an article a user wants. If a user pushes one of the buttons, a signal, corresponding to the pushed button, is generated to control unit 20, coin mechanism 15 senses defect of the input coins, put into the vending machine, an amount of money, and inputs a resultant signal to control unit 20. If coin mechanism 15 senses that the coins are defective, it allows the input coins to be given back to the user according to a control signal from control unit 20.

Raw material output sensing part 102, as shown in FIGS. 4 and 5, is installed on a predetermined portion of a raw material output cap 100, through which raw materials from raw material receptacles 9 are supplied to mixing part 13, and consists of a light emitter 104 emitting a light signal, and a light receiver 106 receiving the light signal and providing it to control part 20.

When coin mechanism 15 determines that the amount of input money is more than the article price and an instruction is input from article selection panel 5, control unit 20 produces a control signal for outputting raw materials, and compares the level of a light signal, received through light receiver 106 at the time of outputting raw materials, with its level after completion of raw material supply, thus producing a control signal for vending a corresponding article.

More specifically, control unit 20 compares the initial level of the light signal received through light receiver 106 with its level after outputting raw materials, and if there is no change in the level of the light signal, control unit 20 determines that raw materials are not output to mixing part 13, and produces to coin mechanism 15 a control signal for giving the input coins back to the user. If there is a change in the level of the light signal, control unit 20 determines that raw materials are output to mixing part 13, and produces a signal for supplying hot water and a signal for mixing raw materials in the hot water.

Raw material supply part 10 operates by the output signal of control unit 20, and outputs raw materials of raw material receptacles 9 to mixing part 13. Hot water supply part 12 supplies hot water to mixing part 13 by the control signal of control unit 20, and mixing part 13 mixes the hot water, supplied from hot water supply part 12, with raw materials according to the control signal of control unit 20, and outputs the mixture to a paper cup, put in cup dispenser 6, through nozzles.

Referring to FIGS. 3 to 6, the operation of the inventive raw material sensing apparatus for a vending machine will be described in detail, along with its control sequence.

Once alternating-current (AC) power is applied to the vending machine, the vending machine is initialized by control unit 20 (Step 610), and its state is changed to standby mode (Step 612). When a customer puts coins into a coin slot 4 of the vending machine (Step 614), control unit 20 receives (Step 616) an amount of the input coins from coin mechanism 15, and compares (Step 618) the amount of the input coins to the article price. If control unit 20 determines that the amount of the input coins is more than the article price, it generates a control signal indicative of a possibility of vending the user-selected article, and a display presents the possibility of vending the article for visual reading by control unit 20 (Step 620).

As the user selects a desired article working on article selection panel 5, a signal corresponding to the selected article is input to control unit 20, and control unit 20 produces a control signal for supplying raw materials for the selected article (Step 622). Accordingly, the control signal, output from control unit 20, lets raw material supply part 10 go into action so that the raw materials, held in raw material receptacles 9, are output to mixing part 13 (Step 624), and senses (Step 626) if raw materials are output or not, through raw material output sensing part 102, mounted on a given part of raw material output cap 100 through which the raw materials of raw material receptacles 9 are delivered.

More specifically, a light signal, produced by light emitter 104 of raw material output sensing part 102 at the time of supplying the raw materials from raw material receptacles 9, is input to control unit 20 through light receiver 106. Control unit 20 compares the initial level of the light signal received through light receiver 106 with its level after outputting the raw materials, and if there is no change in the level of the light signal, control unit 20 determines that the raw materials are not output. In case that there is a change in the level of the light signal, control unit 20 determines that raw materials are supplied to mixing part 13.

Once control unit 20 determines that the raw materials are output from raw material receptacles 9, hot water supply part 12 goes into action by a control signal of control unit 20, thus providing hot water to mixing part 13 (Step 628). Mixing part 13 operates by the control signal of control unit 20 to mix the raw materials in the hot water from hot water supply part 12 (Step 630), and the resultant mixture is furnished to cup dispenser 6 (Step 632) so as to be dispensed to the user.

In the meantime, when control unit 20 determines that the raw materials are not output from raw material receptacles 9, it generates a control signal for refunding the coins, put into coin slot 4 by the user, along with a signal for stopping vending. Coin mechanism 15 lets the input coins be given back to the user through coin reject slot 7, and the vending stops according to the output signals of control unit 20 (Step 634).

As described above, the inventive raw material sensing apparatus for a vending machine monitors if raw materials are output from the raw material receptacles through the raw material output sensing part, and allows coins that were put into the vending machine, to be given back to customers in case that the raw materials are used up or some of them form a hard mass by inside moisture, thus not being output.

What is claimed is:

1. A raw material sensing apparatus for a vending machine having a coin mechanism, an article selection panel, raw material receptacles, hot water supply means, mixing means for mixing raw materials from the raw material receptacles with hot water from the hot water supply means, dispensing means for providing a user with a mixture of the hot water and raw materials, said raw material sensing apparatus comprising:

raw material output sensing means, monitoring whether or not raw materials are supplied to the mixing means from the raw material receptacles; and control means checking if raw materials for a user-desired article are supplied from the raw material receptacles according to an output signal of the raw material output sensing means, and when it determines that the raw materials are not supplied from the raw material receptacles, stopping vending, simultaneously with generating a signal for refunding coins, put into the vending machine, to the coin mechanism, and when it determines that the raw materials are supplied from the raw material receptacles, producing a signal for supplying hot water from the hot water supply means to the mixing means and then mixing the raw materials in the hot water, thus dispensing the user with a mixture of the raw materials and hot water.

2. A raw material sensing apparatus as set forth in claim 1, wherein said raw material output sensing means comprises:

light emitting means mounted on a predetermined portion of a raw material output cap to produce a light signal; and light receiving means, receiving the light signal produced from said light emitting means and then inputting the light signal to the control means.

3. A method of sensing raw materials for a vending machine having a coin mechanism, an article selection panel, raw material receptacles, hot water supply means, mixing means for mixing raw materials from the raw material receptacles with hot water from the hot water supply means, dispensing means for providing a user with a mixture of the hot water and raw materials, said method comprising the steps of:

checking if raw materials for a user-selected article are output to the mixing means from the raw material receptacles;

when determining that the raw materials are output therefrom, supplying hot water from the hot water supply means to mixing means so as to mix the raw materials with the hot water and then outputting a mixture of the raw materials and hot water to be dispensed to the user, and when determining that the raw materials are not output therefrom, giving coins, put into the vending machine, back to the user, simultaneously with stopping the vending operation.

* * * * *